US006530235B2

(12) United States Patent
Halimi et al.

(10) Patent No.: US 6,530,235 B2
(45) Date of Patent: Mar. 11, 2003

(54) SELF-CHILLING PORTABLE BEVERAGE CONTAINER ASSEMBLY, AND METHOD

(76) Inventors: Edward Mayer Halimi, 1200 N. San Marcos Rd., Santa Barbara, CA (US) 93111; David T. St. James, 1200 N. San Marcos Rd., Santa Barbara, CA (US) 93111; Melanie S. St. James, 1200 N. San Marcos Rd., Santa Barbara, CA (US) 93111

( * ) Notice: Subject to any disclaimer, the term of this patent is extended or adjusted under 35 U.S.C. 154(b) by 0 days.

(21) Appl. No.: 10/001,368

(22) Filed: Oct. 30, 2001

(65) Prior Publication Data

US 2002/0178743 A1 Dec. 5, 2002

Related U.S. Application Data

(60) Provisional application No. 60/244,942, filed on Nov. 1, 2000.

(51) Int. Cl.[7] ..... F25D 3/08
(52) U.S. Cl. ..... 62/62; 62/294; 62/371
(58) Field of Search ..... 62/294, 293, 371, 62/457.3, 457.4, 62

(56) References Cited

U.S. PATENT DOCUMENTS

| | | | | | |
|---|---|---|---|---|---|
| 2,746,265 | A | * | 5/1956 | Mills | 62/4 |
| 3,373,581 | A | * | 3/1968 | Strader | 62/294 |
| 3,970,068 | A | * | 7/1976 | Sato | 126/263.08 |
| 3,987,643 | A | * | 10/1976 | Willis | 62/371 |
| 4,688,395 | A | * | 8/1987 | Holcomb | 62/294 |
| 5,325,680 | A | * | 7/1994 | Baroso-Lujan et al. | 62/294 |
| 5,384,703 | A | * | 1/1995 | Withgott et al. | 707/531 |
| 5,555,741 | A | * | 9/1996 | Oakley | 62/294 |
| 5,609,038 | A | * | 3/1997 | Halimi | 62/294 |
| 5,941,078 | A | * | 8/1999 | Scudder et al. | 62/4 |
| 6,128,906 | A | * | 10/2000 | Sillince | 62/4 |

* cited by examiner

*Primary Examiner*—William E. Topolcai
(74) *Attorney, Agent, or Firm*—Gene W. Arant

(57) ABSTRACT

A portable beverage container assembly includes a capsule containing a refrigerant which is inserted into and securely held inside the beverage container, together with a mechanism to discharge the refrigerant so that the latent heat of evaporation and expansion of the refrigerant gases will impart a chilling action to the refrigerant and hence to the beverage inside the container when the user wishes to drink the beverage.

9 Claims, 1 Drawing Sheet

SELF-CHILLING PORTABLE BEVERAGE CONTAINER ASSEMBLY, AND METHOD

Figure 1:
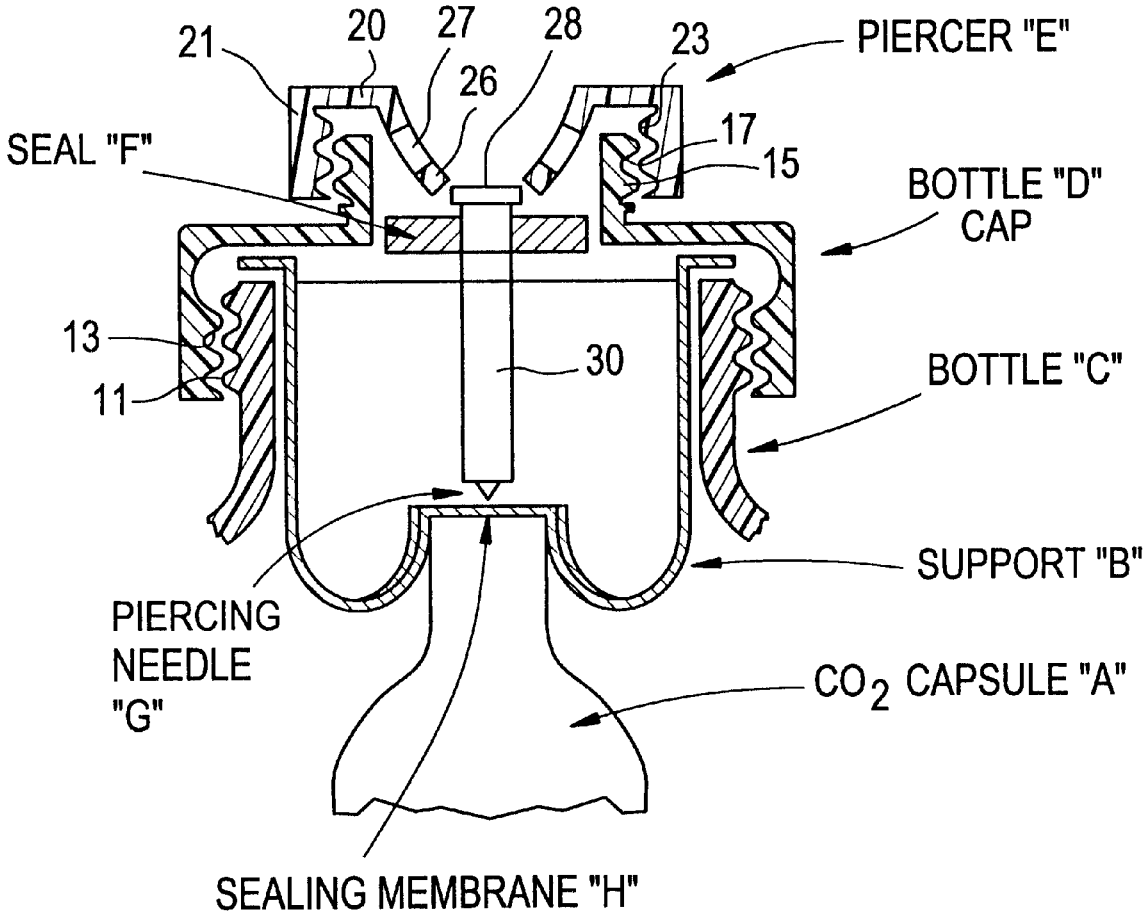

This application claims the benefit of Provisional application No. 60/244,942, filed Nov. 1, 2000.

SUMMARY OF THE INVENTION

According to the present invention a method is provided for chilling a beverage for drinking purposes at a location where ice and refrigerator are not available. An open-topped container is selected for containing the beverage. A refrigerant cartridge is selected having an end opening that is closed by a sealing membrane preferably made of a soft metal. The refrigerant cartridge is inserted into the container with the sealing membrane of the cartridge facing the container top, and is then supported in a fixed position within the container. An elongated cartridge piercing mechanism having on one end thereof a needle point, preferably made of steel, is inserted into the container such that its needle point is adjacent the sealing membrane of the cartridge. After the container has been filled with the beverage, the other end of the cartridge piercing mechanism is adjustably secured to the open end of the container while concurrently securely closing the open end of the container so as to retain the beverage therein. When it is desired to cool and drink the beverage, the outer end of the cartridge piercing mechanism is adjustably moved toward the interior of the container so as to force the needle point of the cartridge piercing mechanism into the sealing membrane of the refrigerant cartridge and thereby release the refrigerant to cool the beverage in the container.

The novel apparatus of the present invention consists of a beverage container, and a capsule containing a refrigerant which is inserted into and securely held inside the beverage container, together with a mechanism to discharge the refrigerant so that the latent heat of evaporation and expansion of the refrigerant gases will impart a chilling action to the refrigerant and hence to the beverage inside the container.

In the presently preferred embodiment of the invention the self-chilling portable beverage container assembly includes a bottle having a neck portion, and a bottle cap that removably closes the neck. A refrigerant cartridge is disposed inside the bottle, and has an end opening closed by a sealing membrane. A hollow cartridge support structure projects through the neck portion of the bottle and hence into the bottle interior, and has a base end that is releasably secured to the neck of the bottle. An elongated cartridge piercing mechanism has one end attached to a central portion of the bottle cap, and also has an operating end with a needle point extending interiorly of the bottle. The refrigerant cartridge is fixedly supported by the cartridge support structure.

For operating the presently preferred form of the container assembly when it is desired to first cool and then drink the contents, a central portion of the bottle cap is made to be selectively movable in a direction inwardly of the bottle to drive the cartridge piercing mechanism further inwardly of the bottle so that its needle point pierces the sealing membrane of the refrigerant cartridge and thereby releases the refrigerant to cool the beverage contained in the remaining portion of the bottle.

DRAWING SUMMARY

The presently preferred form of the invention is illustrated in a single drawing FIGURE, which is a schematic cross-sectional elevational view of the upper end of the container assembly.

DESCRIPTION OF PREFERRED EMBODIMENT

In the presently preferred embodiment the various parts are designated as follows:

A is the refrigerant cartridge; upper end only is shown.

B is the hollow cartridge support structure.

C is the bottle; only an upper end portion is shown.

D is the main bottle cap.

E is the refrigerant cartridge piercing mechanism.

F is a seal with an opening through which mechanism E slidably moves while driving needle G downward.

G is a needle on the lower end of mechanism B

H is a sealing membrane across the upper end of the refrigerant cartridge A

More specifically, capsule A is a refrigerant cartridge containing a refrigerant such as CO2 under pressure. On its upper end which would otherwise be open it has a sealing membrane H, preferably made of soft metal.

B is a hollow structure for supporting the cartridge or capsule A. Although not specifically shown, it has lateral holes or openings for permitting the beverage to flow through the structure.

C is the bottle, typically made of plastic as now commonplace. The neck of the bottle is exteriorly threaded as indicated at numeral 11. The bottle cap D is interiorly threaded as indicated at numeral 13, and the threads of the cap engage the bottle neck in conventional fashion. The preferred assembly also includes a rotatable threaded mechanism associated with the main bottle cap for driving cartridge piercing mechanism E inwardly. Thus Cap D has a central opening with an upwardly extending peripheral flange 15 having external threads 17.

The overall refrigerant cartridge piercing mechanism is designated as E, but has several important separate parts. A first part, which may be considered as an auxiliary cap, is designated by numeral 20, and has a circumferential flange 21 with interior threads 23 that engage threads 17 of the main bottle cap. Also a part of the piercing mechanism auxiliary cap 20 is a generally concave central portion 26 with openings 27 formed therein. At the bottom of central portion 26 there is a flat central portion 28 that essentially acts as a central part of the cap D.

A second part of piercing mechanism E is a plunger 30 whose upper end is attached to the periphery of flat center portion 28 of auxiliary cap 20, while a third part is the piercing needle G which is attached to the lower extremity of plunger 30.

A seal F closes the central opening of bottle cap D when the beverage container has been filled. Seal F is a seal with an opening through which plunger 30 extends, and slidably moves when driving needle G downward.

The container is filled by first inserting the capsule A and its holding structure B inside the bottle, thus securing the capsule in a fixed position. Then the container is moved to a conventional filling and capping machine. Beverage is supplied into the container and flows through openings in the support structure B. The seal F is placed in the opening of main cap D. Then the piercing structure E with its component parts 20, 30, and G is added to the assembly, to seal the beverage under presssure inside the container.

According to the invention the consumer can have an instantly chilled beverage any time and at any location without the need for ice or a refrigerator. When the mechanism is to be operated, piercer cap 20 is twisted to drive the flat wall 28 and plunger 30 downwardly, This causes seal F to move downward a sufficient distance so that beverage can flow past it and outward through the central opening in the main cap. At the same time the needle G is caused to pierce the seal H on the refrigerant capsule A, causing the refrigerant to be released and the beverage content of the container to be cooled.

Various refrigerants can be used for the purpose of the present invention. However, it is essential that the refrigerant be non-toxic and environmentally safe as well as economical to obtain. We have experimented with various refrigerants and have found that liquid carbon dioxide "CO2" is an advantageous refrigerant being non-toxic, having sufficient chilling capacity for its volume and weight, and being abundantly available as a by-product of chemical and steel industries. Our experiments have shown that one gram of CO2 is capable of chilling four grams of water or other beverage by approximately 25 degrees F. Thus, to chill eight ounces of beverage by 25 degrees F., approximately 60 grams of CO2 is required. The use of our chilling mechanism therefore reduces the volume available for the beverage by less than about one-fourth.

Other modifications within the scope of our inventive concept will be apparent to those persons skilled in the art.

We have disclosed the presently preferred embodiment of our invention in detail in order to comply with requirements of the patent laws, but it is to be understood that the scope of the invention is to be measured only in accordance with the appended claims.

What we claim is:

1. A self-chilling beverage container assembly comprising:

a bottle having a neck portion with an end surface and a circumferential exterior thread about the neck;

a cartridge support member of a generally dome-shaped configuration, and having a base end with an outwardly extending flange thereon, the cartridge support member projecting inside the neck portion of the bottle and having its base end flange in engagement with the end surface of the bottle neck;

a refrigerant cartridge inside the bottle, having an end surface engaging with and supported by the cartridge support member;

a bottle cap having an interiorly threaded circumferential wall and a bottom wall, the bottom wall having a central opening therein, the interiorly threaded circumferential wall of the bottle cap engaging the exterior threads of the bottle neck;

a sealing member disposed within the central opening of the bottle cap and extending thereacross; and an elongated cartridge piercing mechanism having one end portion adjustably attached to the bottle cap, an intermediate portion extending through the seal member, and an operating end positioned in close proximity to the interengaging portions of the cartridge support member and refrigerant cartridge;

whereby upon adjustment of the cartridge piercing mechanism inwardly relative to the bottle cap its operating end opens the refrigerant cartridge and thereby releases the refrigerant to cool the beverage contained in the remaining portion of the bottle.

2. The assembly of claim 1 wherein the bottom wall of the bottle cap neck portion and the associated end portion of the cartridge piercing mechanism have interengaging threaded surfaces.

3. The assembly of claim 1 wherein the refrigerant cartridge has a sealing membrane closing its end adjacent the cartridge support member.

4. The assembly of claim 3 wherein the operating end of the cartridge piercing mechanism carries a needle point for piercing the sealing membrane of the refrigerant cartridge.

5. A portable self-chilling beverage container assembly comprising:

a bottle having a neck portion, and a bottle cap removably closing the neck;

a hollow cartridge support structure projecting through the neck portion of the bottle and hence into the bottle interior, having a base end releasably secured to the neck of the bottle;

an elongated cartridge piercing mechanism having one end attached to a central portion of the bottle cap, and an operating end with a needle point thereon extending interiorly of the bottle;

a refrigerant cartridge inside the bottle, having an end opening that is closed by a sealing membrane, the associated end of the refrigerant cartridge being supported by the cartridge support structure; and the central portion of the bottle cap being movable in a direction inwardly of the bottle for concurrently forcing the cartridge piercing mechanism further inwardly of the bottle so that the needle point pierces the sealing membrane of the refrigerant cartridge and thereby releases the refrigerant to cool the beverage contained in the remaining portion of the bottle.

6. The assembly of claim 5 wherein the neck of the bottle is exteriorly threaded and the bottle cap is interiorly threaded.

7. The assembly of claim 5 which further includes a rotatable threaded mechanism associated with the central portion of the bottle cap for driving the cartridge piercing mechanism inwardly.

8. The method of chilling a beverage for drinking purposes when ice and refrigerator are not available, comprising steps of:

selecting an open-topped container for the beverage;

selecting a refrigerant cartridge having an end opening that is closed by a sealing membrane;

inserting the refrigerant cartridge into the container with the sealing membrane of the cartridge facing the container top;

supporting the refrigerant cartridge in a fixed position within the container;

selecting an elongated cartridge piercing mechanism having a needle point on one end thereof, and then inserting the cartridge piercing mechanism into the container such that its needle point is adjacent the sealing membrane of the cartridge;

filling the container with the beverage;

adjustably securing the other end of the cartridge piercing mechanism to the open end of the container while concurrently securely closing the open end of the container so as to retain the beverage therein; and when it is desired to cool and drink the beverage, adjustably moving the other end of the cartridge piercing mechanism toward the interior of the container so as to force the needle point of the cartridge piercing mechanism into the sealing membrane of the refrigerant cartridge and thereby release the refrigerant to cool the beverage in the container.

9. The method of claim 8 wherein the needle point of the cartridge piercing mechanism is made of steel and the membrane closing the refrigerant cartridge is made of a soft metal.

* * * * *